US011835021B1

(12) United States Patent
Pickett

(10) Patent No.: US 11,835,021 B1
(45) Date of Patent: Dec. 5, 2023

(54) PORTABLE ENGINE STARTER FOR RACING

(71) Applicant: J&J Motorsports, Inc., Stony Point, NC (US)

(72) Inventor: Jonathan T. Pickett, Stony Point, NC (US)

( * ) Notice: Subject to any disclaimer, the term of this patent is extended or adjusted under 35 U.S.C. 154(b) by 0 days.

(21) Appl. No.: 18/140,688

(22) Filed: Apr. 28, 2023

Related U.S. Application Data

(60) Provisional application No. 63/337,646, filed on May 3, 2022.

(51) Int. Cl.
*F02N 11/00* (2006.01)
*F02N 11/12* (2006.01)
*F02N 11/08* (2006.01)

(52) U.S. Cl.
CPC ..... *F02N 11/12* (2013.01); *F02N 11/087* (2013.01); *F02N 11/0862* (2013.01)

(58) Field of Classification Search
CPC ..... F02N 11/0862; F02N 11/087; F02N 11/12
See application file for complete search history.

(56) References Cited

U.S. PATENT DOCUMENTS 2,475,750 A * 7/1949 Mccormick ..... F02N 11/12 318/447
2,909,065 A * 10/1959 Wiggins ..... F02N 11/12 192/42
3,437,083 A * 4/1969 Hamman ..... F02N 11/12 123/179.26
3,939,369 A * 2/1976 Sullivan ..... F02N 11/12 123/185.7
6,837,202 B1 * 1/2005 Lu ..... F02N 11/12 310/83
7,530,340 B1 * 5/2009 Jellinek ..... F02N 11/12 123/179.25
7,748,360 B2 * 7/2010 Thompson ..... F02N 11/12 123/185.3
8,490,592 B1 * 7/2013 Von Tiergen ..... F02N 11/12 123/179.25
2002/0046723 A1 * 4/2002 Arlton ..... F02B 75/34 123/179.27
2006/0267345 A1 * 11/2006 Lu ..... F02N 11/12 290/38 R
2007/0000466 A1 * 1/2007 Thompson ..... F02N 15/006 123/179.25

(Continued)

*Primary Examiner* — Phutthiwat Wongwian
*Assistant Examiner* — Sherman D Manley
(74) *Attorney, Agent, or Firm* — Kyle A. Fletcher, Esq.

(57) ABSTRACT

The portable engine starter for vehicle racing may be an electromechanical structure configured for use with an engine in a vehicle. As a non-limiting example, the engine may be a combustion engine. The portable engine starter may detachably couple to the engine and may be operable to start the engine. The rotation of a starting motor located within the portable engine starter may provide the motive forces used to start the engine in the vehicle. The portable engine starter may be an independently powered structure. The portable engine starter may include a housing, the starting motor, and a power circuit. The housing may enclose the starting motor and the power circuit. The power circuit may electrically connect to the starting motor. The portable engine starter may be detached from the vehicle once the engine of the vehicle is started.

20 Claims, 9 Drawing Sheets

(56) References Cited

U.S. PATENT DOCUMENTS

| | | | | |
|---|---|---|---|---|
| 2009/0183708 | A1* | 7/2009 | Liu | F02N 11/12 446/454 |
| 2010/0001524 | A1* | 1/2010 | Liu | F02N 11/12 290/31 |
| 2011/0101704 | A1* | 5/2011 | Chau | F02N 11/00 290/38 R |
| 2016/0375528 | A1* | 12/2016 | Pawlicki | F02N 19/00 29/888.011 |
| 2018/0209391 | A1* | 7/2018 | Ma | F02N 11/12 |
| 2019/0293041 | A1* | 9/2019 | Dong | B25F 5/001 |
| 2020/0124011 | A1* | 4/2020 | Deguara | F02N 11/087 |

* cited by examiner

PORTABLE ENGINE STARTER FOR RACING

CROSS REFERENCES TO RELATED APPLICATIONS

This application claims the benefit of priority to U.S. Provisional Application No. 63/337,646, filed May 3, 2022, which is incorporated by reference herein in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of starting aids for combustion engines, more specifically, a portable engine starter for vehicle racing.

SUMMARY OF INVENTION

The portable engine starter for vehicle racing may be an electromechanical structure configured for use with an engine in a vehicle. As a non-limiting example, the engine may be a combustion engine. The portable engine starter may detachably couple to the engine and may be operable to start the engine. The rotation of a starting motor located within the portable engine starter may provide the motive forces used to start the engine in the vehicle. The portable engine starter may be an independently powered structure. By independently powered is meant that the portable engine starter can operate without an electrical connection to an external power source. The portable engine starter may comprise a housing, the starting motor, and a power circuit. The housing may enclose the starting motor and the power circuit. The power circuit may electrically connect to the starting motor. The portable engine starter may be detached from the vehicle once the engine of the vehicle is started. The portable engine starter may eliminate from the vehicle the weight and space penalties associated with carrying the starting motor, a battery, and associated circuitry on-board.

An object of the invention is to start an engine in a vehicle.

Another object of the invention is to provide a starting motor that may detachably couple to the engine of the vehicle.

A further object of the invention is to provide a power circuit that may provide electrical energy to energize the starting motor.

Yet another object of the invention is to provide a switching circuit that may control the application of electrical energy to the starting motor.

These together with additional objects, features and advantages of the portable engine starter for vehicle racing will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable engine starter for vehicle racing in detail, it is to be understood that the portable engine starter for vehicle racing is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable engine starter for vehicle racing.

It is therefore important that the claims be regarded as including such equivalent construction insofar as they do not depart from the spirit and scope of the portable engine starter for vehicle racing. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
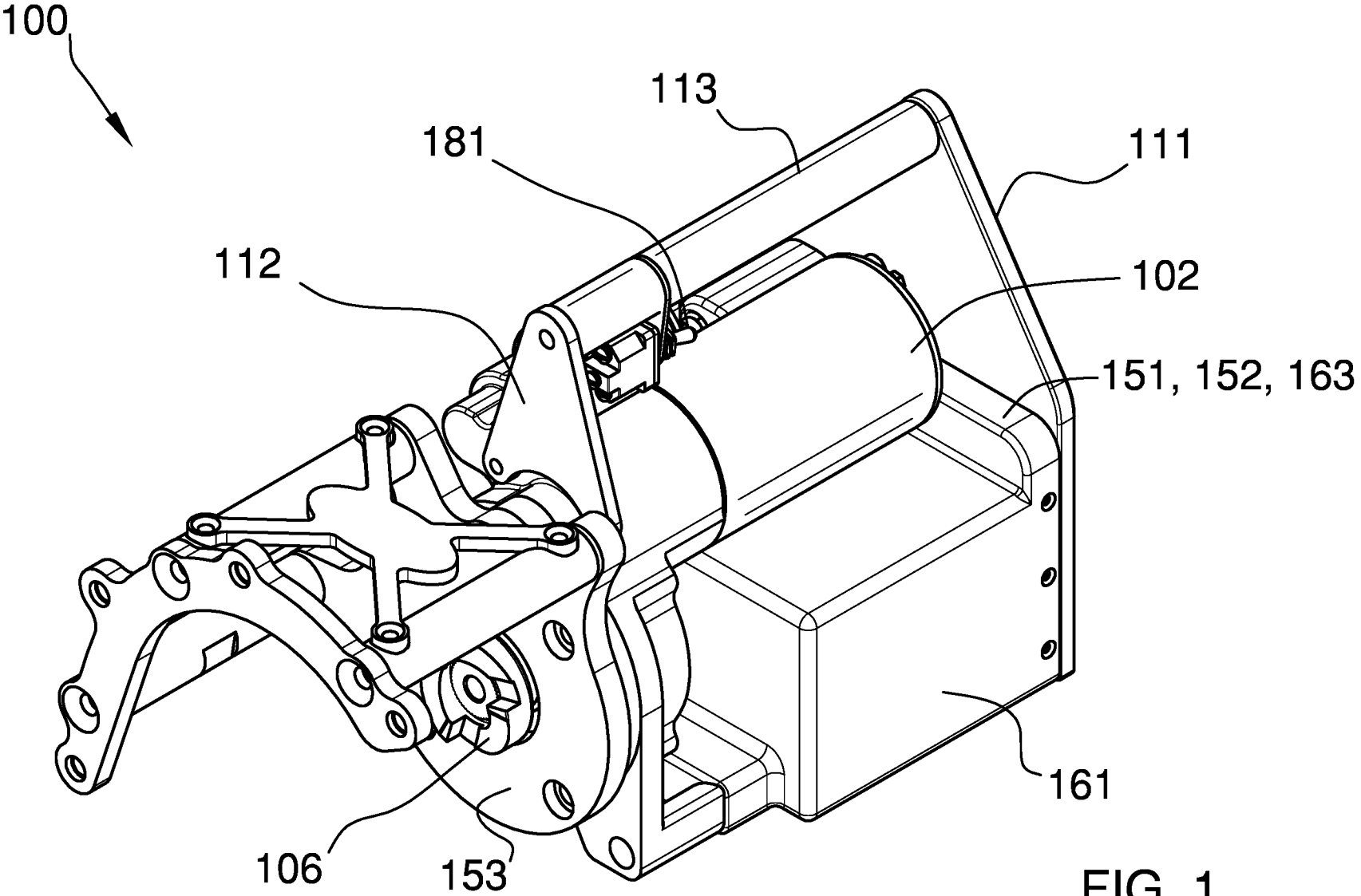
FIG. 1 is a top isometric view of a first embodiment of the disclosure.
Figure 2:
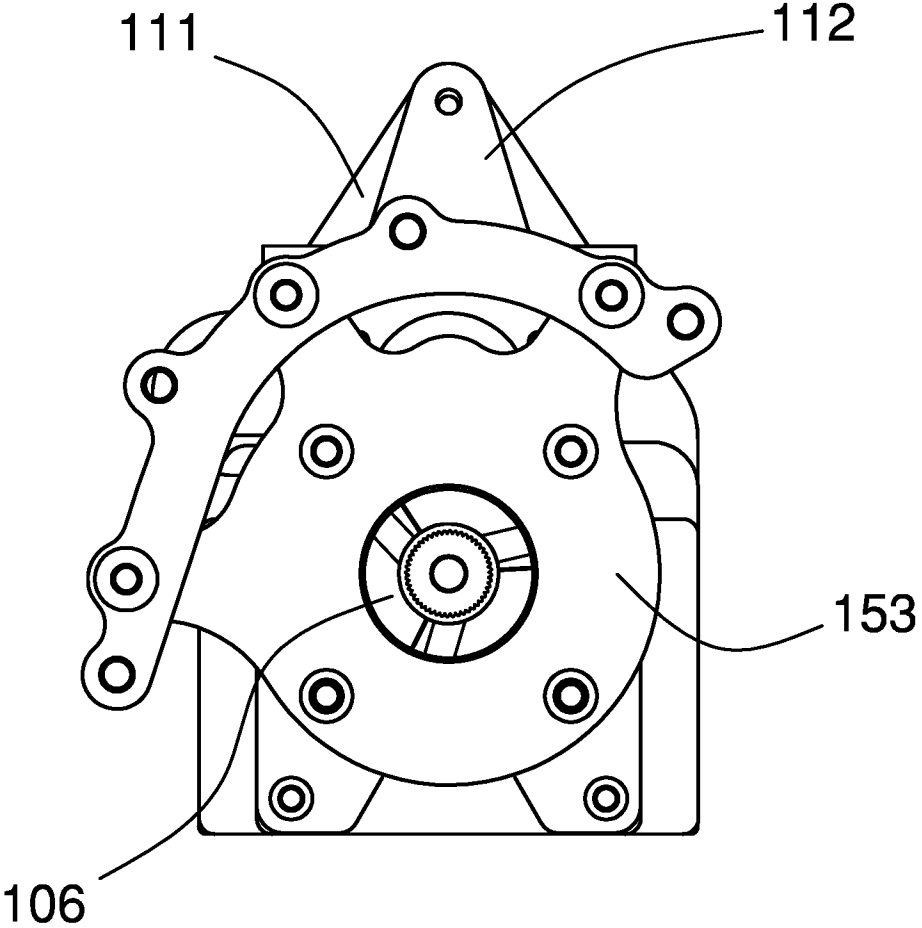
FIG. 2 is a front view of a first embodiment of the disclosure.
Figure 3:
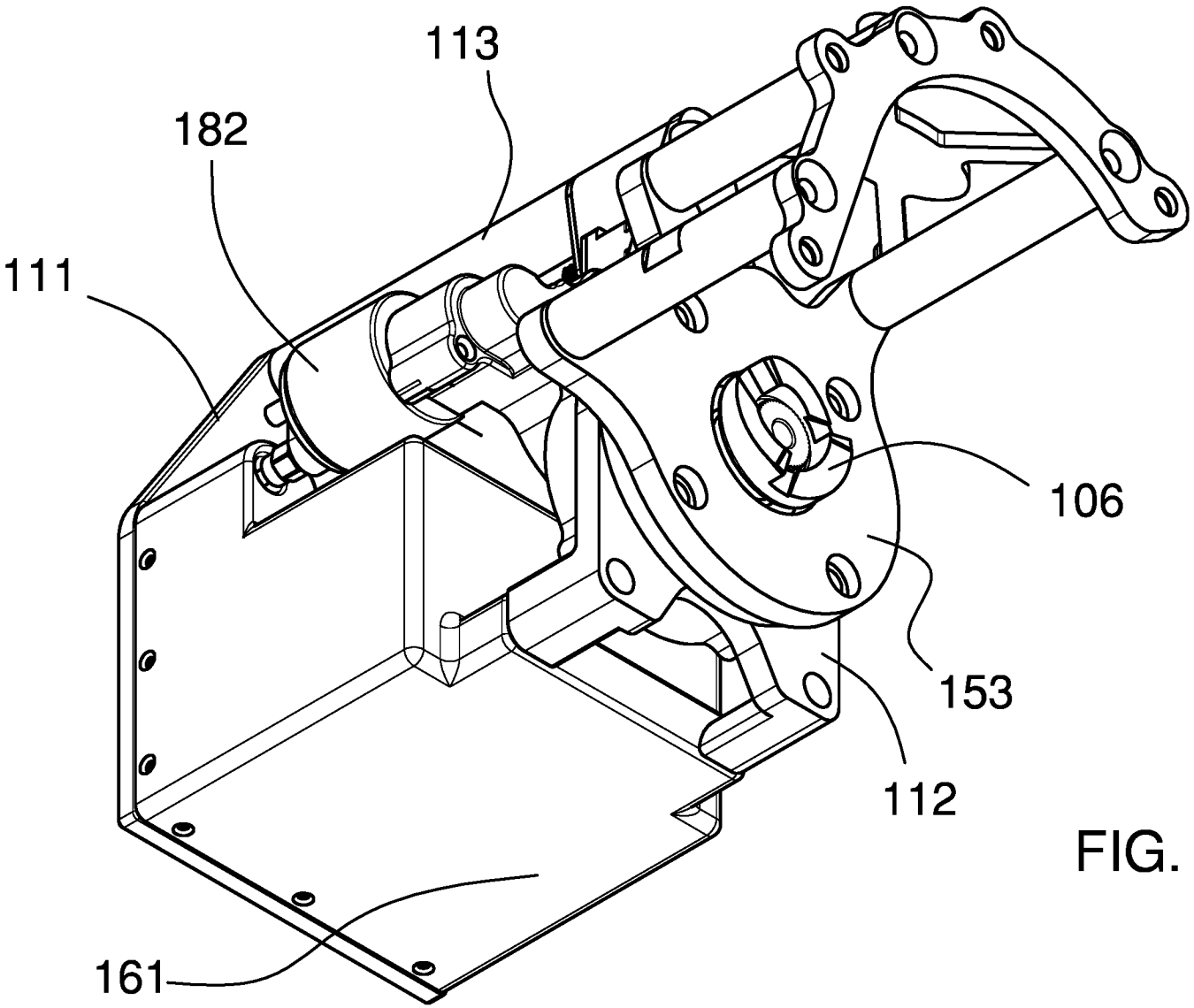
FIG. 3 is a bottom isometric view of a first embodiment of the disclosure.
Figure 4:
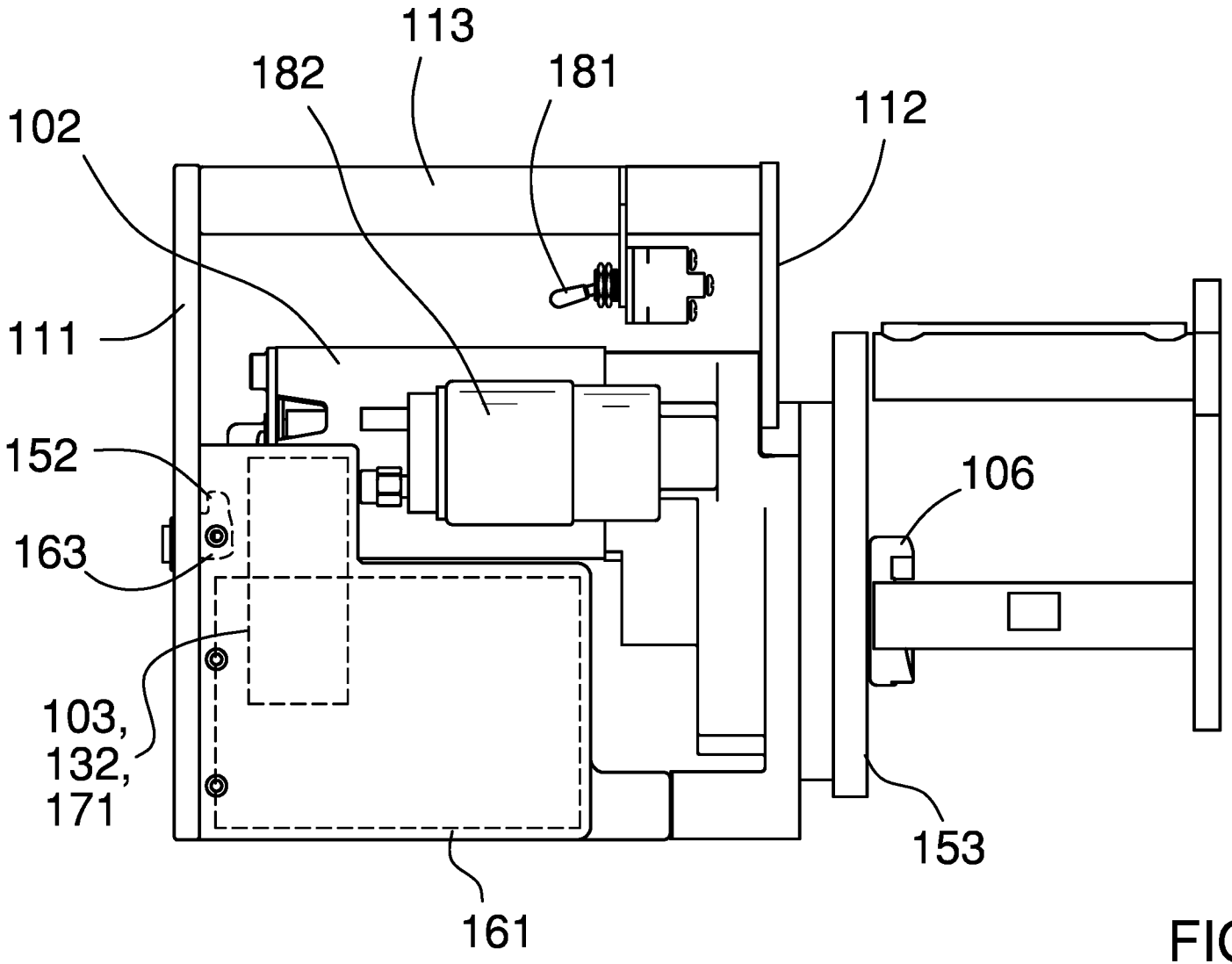
FIG. 4 is a side view of a first embodiment of the disclosure.
Figure 5:
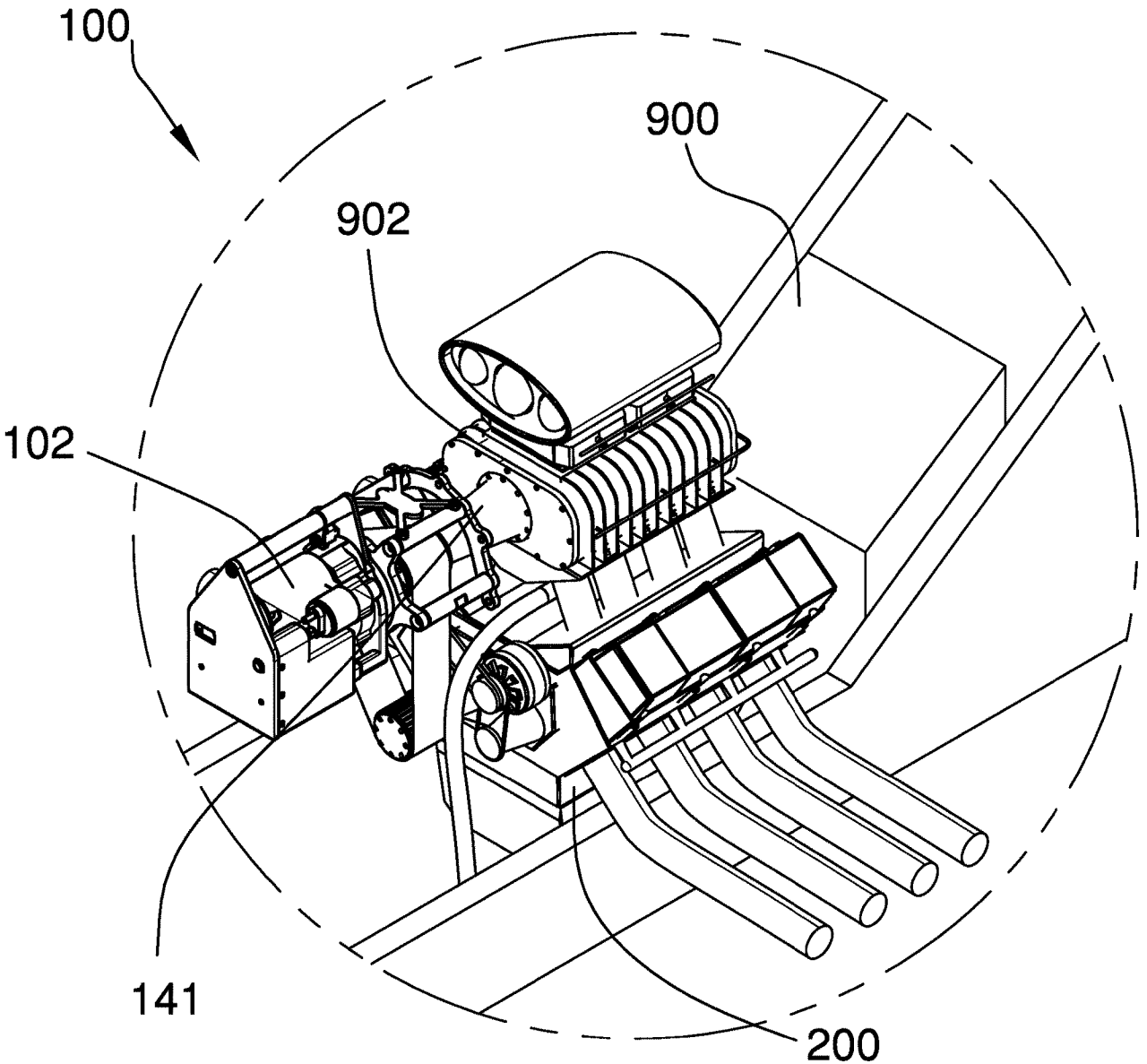
FIG. 5 is an in-use view of a first embodiment of the disclosure.
Figure 6:
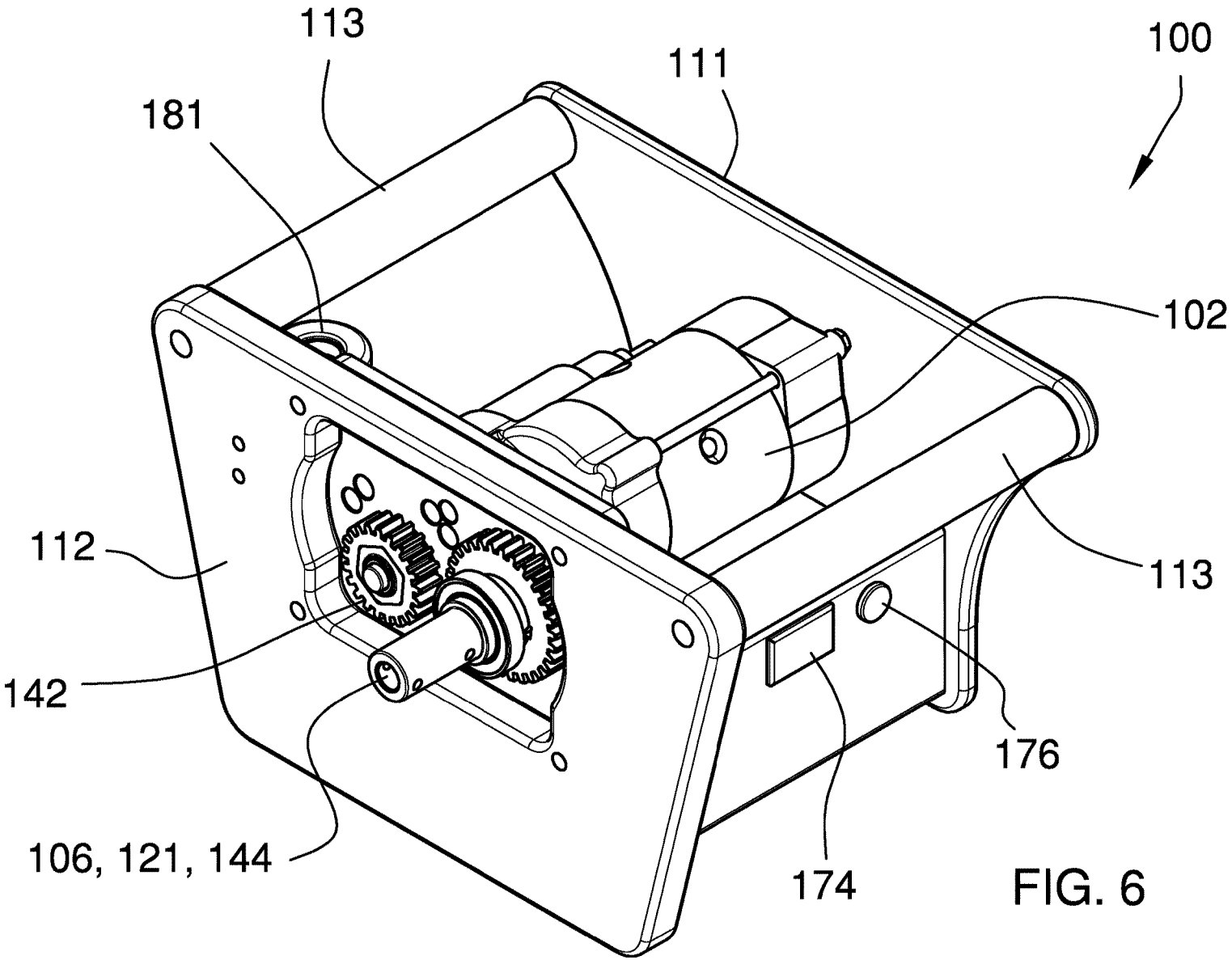
FIG. 6 is an isometric view of a second embodiment of the disclosure.
Figure 7:
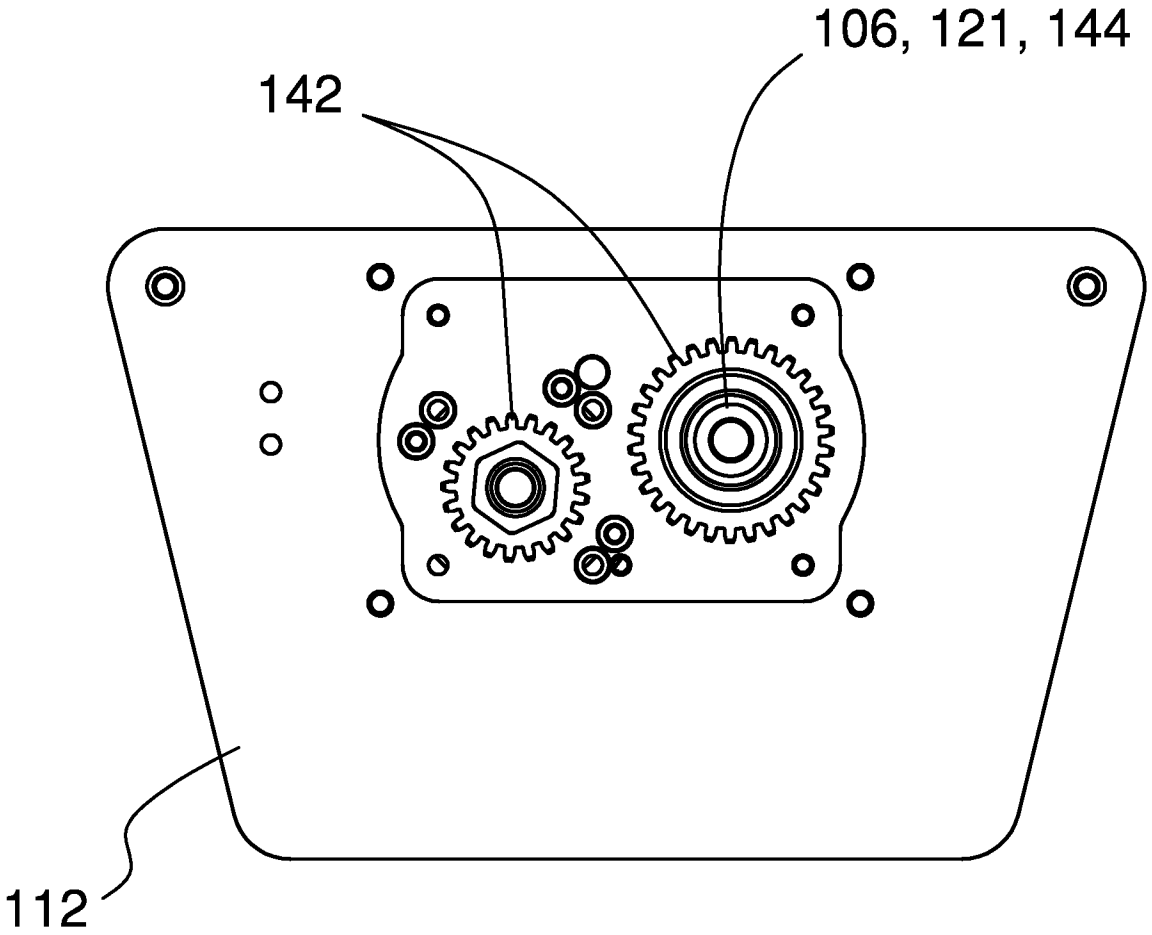
FIG. 7 is a front view of a second embodiment of the disclosure.
Figure 8:
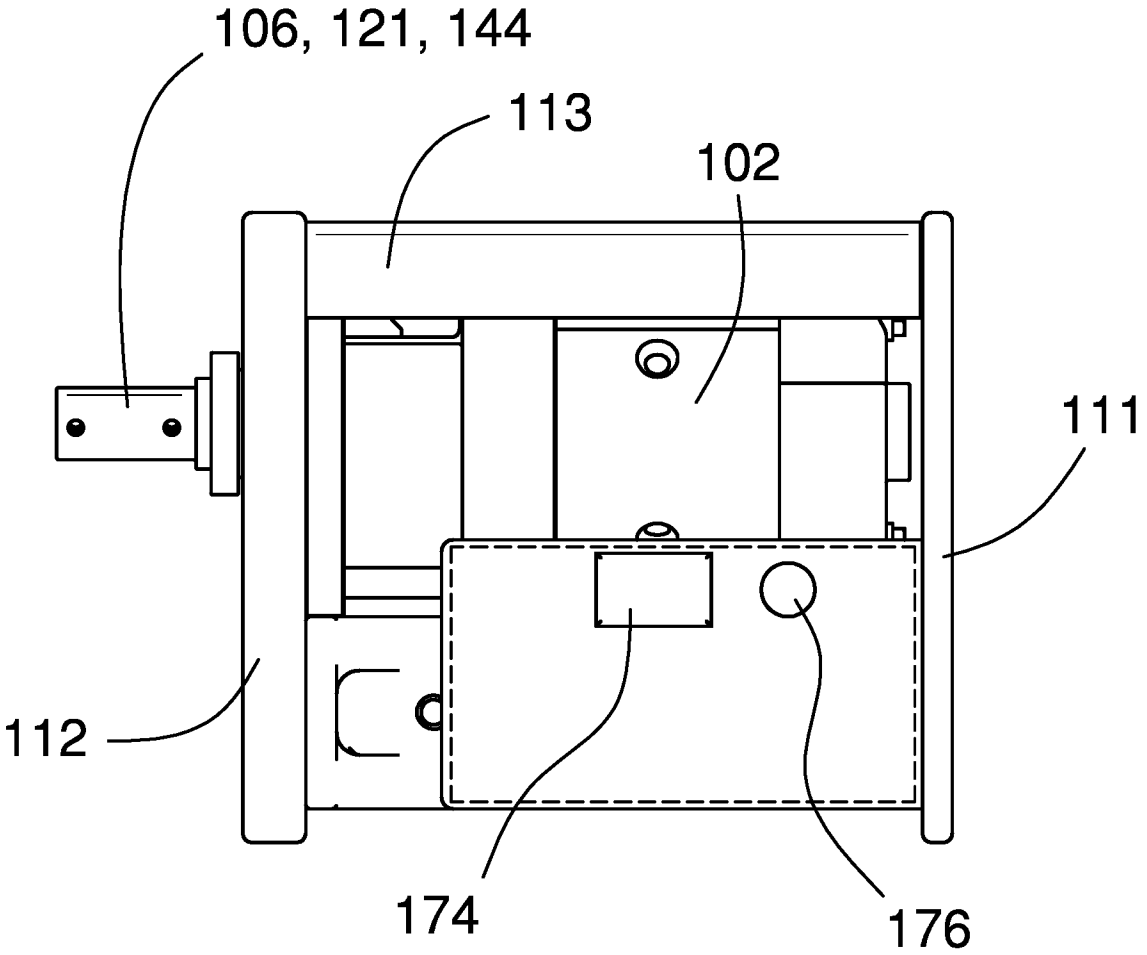
FIG. 8 is a side view of a second embodiment of the disclosure.
Figure 9:
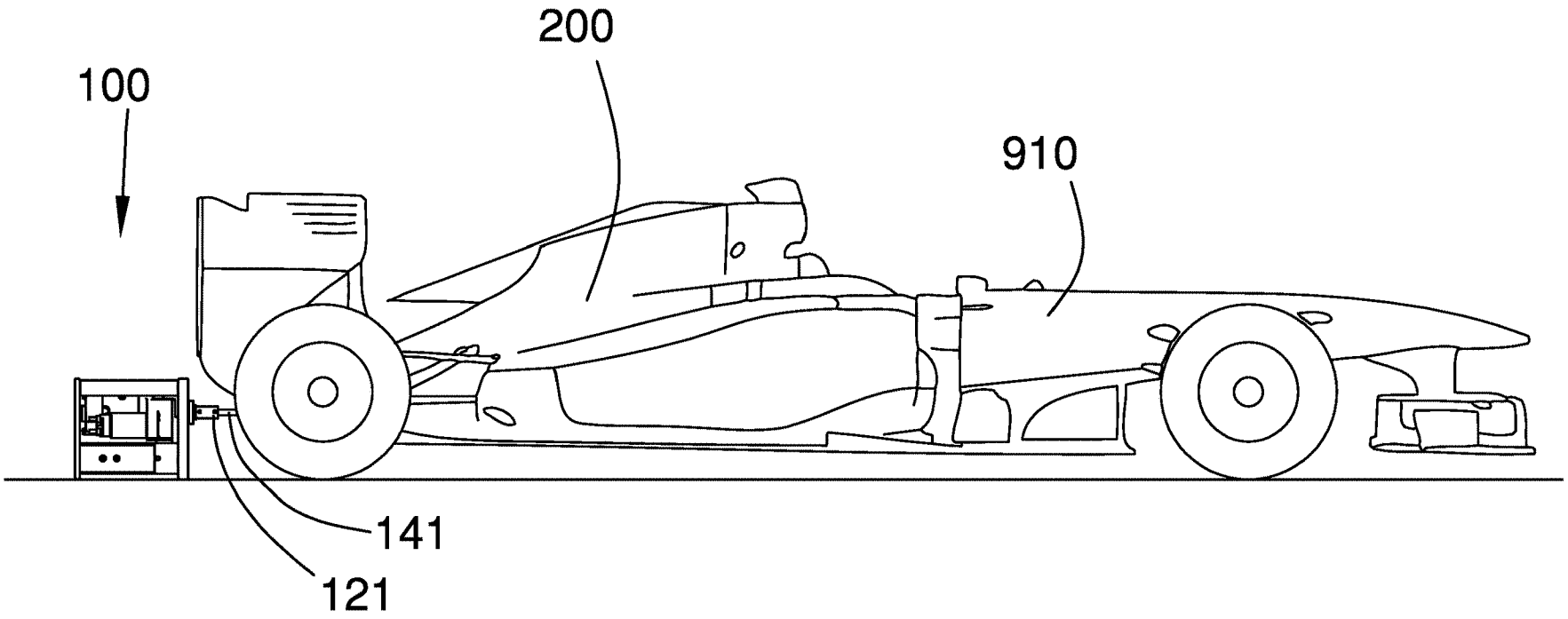
FIG. 9 is an in-use view of a second embodiment of the disclosure.

Detailed reference will now be made to a first potential embodiment of the disclosure, which is illustrated in FIGS. 1 through 9.

The portable engine starter for vehicle racing 100 (hereinafter invention) may be an electromechanical structure configured for use with an engine 200 in a vehicle. As a non-limiting example, the engine 200 may be a combustion engine. The invention 100 may detachably couple to the engine 200 and may be operable to start the engine 200. The rotation of a starting motor 102 located within the invention 100 may provide the motive forces used to start the engine 200 in the vehicle. The invention 100 may be an independently powered structure. By independently powered is meant that the invention 100 can operate without an electrical connection to an external power source. The invention 100 may comprise a housing, the starting motor 102, and a power circuit 103. The housing may enclose the starting motor 102 and the power circuit 103. The power circuit 103 may electrically connect to the starting motor 102. The invention 100 may be detached from the vehicle once the engine 200 of the vehicle is started. The invention 100 may eliminate from the vehicle the weight and space penalties associated with carrying the starting motor 102, a battery 161, and associated circuitry on-board.

The vehicle may be a motorized vehicle propelled by the engine 200. The vehicle may further comprise an engine start interface 141. The engine start interface 141 may be a mechanical structure. The engine start interface 141 may form a mechanical linkage with the starting motor 102 via an engine coupler 106. The engine start interface 141 may form a mechanical linkage with the engine 200 of the vehicle. The engine start interface 141 may detachably attach to the starting motor 102 via the engine coupler 106 such that the rotation of the starting motor 102 rotates the engine start interface 141. The rotation of the engine start interface 141 may build compression in the engine 200 of the vehicle that may start the engine 200 without the need for an internal electric motor.

The housing may be a rigid structure. The housing may comprise the starting motor 102 and the power circuit 103. The housing may form a protection space used to contain the starting motor 102 and the power circuit 103. The housing may be formed with all apertures and form factors necessary to allow the housing to accommodate the use and operation of the starting motor 102 and the power circuit 103. Methods to form the housing suitable for the purposes described in this disclosure are well-known and documented in the mechanical arts. The housing may comprise a rear plate 111, a front plate 112, and one or more handles 113.

The rear plate 111 may be a rigid structure. The rear plate 111 may form a barrier structure that encloses a portion of the protection space formed by the housing. The rear plate 111 may further comprise a battery mount 151 and a battery plug 152. The battery mount 151 may be a mounting structure. The battery 161 may removably attach to the battery mount 151. The battery plug 152 may be an electrical connection. The battery 161 may form a detachable electrical connection with the battery plug 152. The battery plug 152 may form an electrical connection between the battery 161 and a switching circuit 132. The battery plug 152 may transmit the electrical energy generated by the battery 161 to the switching circuit 132.

The front plate 112 may be a rigid structure. The front plate 112 may form a barrier structure that encloses a portion of the protection space formed by the housing. The front plate 112 may further comprise a transfer mount 153. The transfer mount 153 may secure the starting motor 102 to the housing.

The one or more handles 113 may be adapted for a user to grasp in order to carry the invention 100. The one or more handles 113 may secure the rear plate 111 to the front plate 112 to form the protection space of the housing.

The starting motor 102 may be an electric motor. The starting motor 102 may convert electrical energy into rotational energy. The starting motor 102 may mechanically attach to the engine start interface 141 of the engine 200 of the vehicle. The rotation of the starting motor 102 may generate compression within the engine 200 of the vehicle may that start the engine 200. The starting motor 102 may further comprise a starting shaft 121. The starting shaft 121 may be a rigid structure. The starting shaft 121 may be a prism shaped structure. The starting shaft 121 may form a shaft. The starting shaft 121 may attach to the starting motor 102 such that the rotation of the starting motor 102 rotates the starting shaft 121. The center axis of the starting shaft 121 may align with the center axis of the rotor of the starting motor 102. The axis of rotation of the starting shaft 121 may align with the axis of rotation of the starting motor 102.

The power circuit 103 may be an electrical circuit. The power circuit 103 may electrically connect to the starting motor 102. The power circuit 103 may transmit electrical energy from the battery 161 to the starting motor 102. The power circuit 103 may control the flow of electrical energy to the starting motor 102. The power circuit 103 may comprise the battery 161 and the switching circuit 132.

The battery 161 may be an electrochemical device. The battery 161 may contain chemical potential energy. The battery 161 may convert the stored chemical potential energy into electrical energy. The battery 161 may further comprise a battery port 163. The battery port 163 may be an electrical port that may form the electrical connection between the battery plug 152 and the battery 161.

The switching circuit 132 may be an electrical circuit. The switching circuit 132 may control the operation of the invention 100 by controlling the flow of electrical energy into the starting motor 102. The switching circuit 132 may comprise a starting circuit 171. The starting circuit 171 may be an electrical circuit. The starting circuit 171 may electrically connect the battery 161 to the starting motor 102. The starting circuit 171 may transport the electrical energy generated by the battery 161 to the starting motor 102. The starting circuit 171 may further comprise a starting switch 181 and a relay 182.

The relay 182 may be an electrically operated switch. The relay 182 may control the flow of electrical energy from the battery 161 to the starting motor 102. The relay 182 may comprise one or more normally open switches. The relay 182 may further comprise a relay coil and a relay switch structure. The relay 182 may also be referred to as a starting solenoid, and is well known in the field of motorized vehicles.

The relay coil may be an electrical structure. The relay coil may actuate the relay switch structure to a closed position when the relay coil receives electrical energy from the battery 161. The relay switch structure may form an electrical connection between the battery 161 and the starting motor 102 that may feed electrical energy to the starting motor 102.

The starting switch 181 may be a momentary switch. The starting switch 181 may be a normally open switch. The starting switch 181 may control the flow of electrical energy from the battery 161 to the relay coil of the relay 182. The starting switch 181 may maintain the relay coil in an energized condition until the starting switch 181 is deactivated.

In some embodiments, the invention 100 may comprise a voltage gauge 174 and a voltage gauge switch 176. The voltage gauge 174 may measure and display the voltage level of the battery 161 when the voltage gauge switch 176 is activated. As a non-limiting example, observing the voltage level of the battery 161 may provide an indication of a low battery charge since the voltage may decline as the battery 161 is discharged. The voltage gauge switch 176 may be a momentary contact switch such that the voltage gauge 174 may be electrically disconnected to avoid draining the battery 161

In some embodiments, the invention 100 may be configured to detachably couple to a dragster 900. As a non-limiting example, the invention 100 may couple to the front of the engine 200 at a blower 902 or onto a crank of the engine 200.

In some embodiments, the invention 100 may be configured to detachably couple to an Indy car 910. As a non-limiting example, the invention 100 may rest on the ground behind the Indy car 910 and may couple to the engine 200 via a gear set 142 and a socket 144.

In use, the invention 100 may be detachably coupled to the engine 200 of the vehicle. Coupling the invention 100 to the engine 200 may comprise engaging the starting motor 102 with the engine start interface 141. The user may activate the starting switch 181 to energize the starting motor 102 from the battery 161 via the relay 182 causing the engine 200 to turn. Once the engine 200 starts, the invention 100 may be decoupled from the vehicle.

Definitions

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface or object. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, the "center axis" may be the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw. In some embodiments, a control may alter an electrical property of a circuit such as resistance, inductance, or capacitance.

As used herein, the words "couple", "couples", "coupled" or "coupling", may refer to connecting, either directly or indirectly, and does not necessarily imply a mechanical connection.

As used herein, "dragster" may refer to a racing car that is specialized for use in drag racing. The race may follow a straight course from a standing start over a measured distance which is most commonly ¼ mile.

As used in this disclosure, an "electric motor" may be a device that converts electric energy into rotational mechanical energy.

As used herein, "energize" and/or "energization" may refer to the application of an electrical potential to a system or subsystem. "De-energize" and/or "de-energization" may refer to the removal of the electrical potential.

As used in this disclosure, an "engine" may be a device with moving parts that is used to convert energy into rotational or linear motion.

As used in this disclosure, an "external power source" may be a source of the energy that is externally provided to enable the operation or recharging of a device. Examples of external power sources include, but are not limited to, electrical power sources and compressed air sources.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "housing" may be a rigid or semi-rigid casing that encloses and protects one or more devices.

As used herein, "IndyCar" may refer to a car racing league or to race cars designed to compete in IndyCar events. An IndyCar vehicle comprises a single seat, open cockpit, and an engine mounted behind the driver.

As used in this disclosure, a "mechanical linkage" may be an interconnected arrangement of components that are used to manage the transfer of a movement or a force. A mechanical linkage is often referred to as a linkage.

As used in this disclosure, a "momentary switch" may be a biased switch in the sense that the momentary switch has a baseline position that only changes when the momentary switch is actuated. The momentary switch then returns to the baseline position once the actuation is completed. This baseline position is called the "normal" position. As a non-limiting example, a "normally open" momentary switch interrupts (opens) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

As used herein, the word "portable" may refer to a device that may be carried by a single person and may be used at multiple locations. In some cases, portable may imply that the device may be used while being carried.

As used in this disclosure, a "prism" may be a 3 dimensional geometric structure wherein the form factor of two faces of the prism are congruent and the two congruent faces are parallel to each other. The two congruent faces are also commonly referred to as the ends of the prism. The surfaces that connect the two congruent faces are called that lateral faces. In this disclosure, when further description is required, a prism will be named for the geometric or descriptive name of the form factor of the two congruent faces. If the form factor of the two corresponding faces has no clearly established geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

As used in this disclosure, "protection space" may refer to a space formed by a boundary structure. The boundary structure may form a protective barrier that protects objects outside the protection space from potential dangers from the operation of a device or process contained within the protection space.

As used in this disclosure, a "relay" may be an automatic electromagnetic or electromechanical device that reacts to changes in voltage or current by opening or closing a switch in an electric circuit. Relays further defined with a coil and a switch. Applying a voltage to the coil, usually referred to as energizing the coil, will cause the coil to change the position of the switch. Note: Though transistors can be configured to perform switching functions, transistors used for switching functions are handled separately in this disclosure and are explicitly excluded from this definition.

As used in this disclosure, a "rigid structure" may be a solid structure that is inflexible and will not deform before breaking under a force.

As used in this disclosure, the term "shaft" may be used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used in this disclosure, a "motorized vehicle" may be a vehicle that can move under power provided by a motor that is located within the vehicle. The motor may be an electric motor or an internal combustion engine.

With respect to the above description, it is to be realized that the optimum dimensional relationship for the various components of the invention described above and in FIGS. 1 through 9, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable engine starter for vehicle racing
- wherein the portable engine starter for vehicle racing is an electromechanical structure configured for use with an engine in a vehicle;
- wherein the portable engine starter for vehicle racing detachably couples to the engine and is operable to start the engine;
- wherein the rotation of a starting motor located within the portable engine starter for vehicle racing provides the motive forces used to start the engine in the vehicle;
- wherein the portable engine starter for vehicle racing is an independently powered structure;
- wherein the portable engine starter for vehicle racing comprises a housing, the starting motor, and a power circuit;
- wherein the housing forms a protection space used to contain the starting motor and the power circuit.

2. The portable engine starter for vehicle racing according to claim 1
- wherein the housing encloses the starting motor and the power circuit;
- wherein the power circuit electrically connects to the starting motor;
- wherein the portable engine starter for vehicle racing is detached from the vehicle once the engine of the vehicle is started.

3. The portable engine starter for vehicle racing according to claim 2 wherein the vehicle is a motorized vehicle propelled by the engine;
- wherein the vehicle further comprises an engine start interface;
- wherein the engine start interface is a mechanical structure;
- wherein the engine start interface forms a mechanical linkage with the starting motor via an engine coupler;
- wherein the engine start interface forms a mechanical linkage with the engine of the vehicle;
- wherein the engine start interface detachably attaches to the starting motor via the engine coupler such that the rotation of the starting motor rotates the engine start interface;
- wherein the rotation of the engine start interface builds compression in the engine of the vehicle that starts the engine.

4. The portable engine starter for vehicle racing according to claim
- wherein the housing is a rigid structure;
- wherein the housing comprises the starting motor and the power circuit;
- wherein the housing is formed with all apertures and form factors to allow the housing to accommodate the use and operation of the starting motor and the power circuit;
- wherein the housing comprises a rear plate, a front plate, and one or more handles.

5. The portable engine starter for vehicle racing according to claim 4
- wherein the rear plate is a rigid structure;

wherein the rear plate forms a barrier structure that encloses a portion of the protection space formed by the housing;

wherein the rear plate further comprises a battery mount;

wherein the battery mount is a mounting structure;

wherein a battery removably attaches to the battery mount.

6. The portable engine starter for vehicle racing according to claim 5 wherein the front plate is a rigid structure;

wherein the front plate forms a barrier structure that encloses a portion of the protection space formed by the housing;

wherein the front plate further comprises a transfer mount;

wherein the transfer mount secures the starting motor to the housing.

7. The portable engine starter for vehicle racing according to claim 6 wherein the one or more handles are adapted for a user to grasp in order to carry the portable engine starter for vehicle racing;

wherein the one or more handles secure the rear plate to the front plate to form the protection space of the housing.

8. The portable engine starter for vehicle racing according to claim 7 wherein the starting motor is an electric motor;

wherein the starting motor converts electrical energy into rotational energy;

wherein the starting motor mechanically attaches to the engine start interface of the engine of the vehicle;

wherein the rotation of the starting motor generates compression within the engine of the vehicle that starts the engine;

wherein the starting motor further comprises a starting shaft.

9. The portable engine starter for vehicle racing according to claim 8 wherein the starting shaft is a rigid structure;

wherein the starting shaft is a prism shaped structure;

wherein the starting shaft forms a shaft;

wherein the starting shaft attaches to the starting motor such that the rotation of the starting motor rotates the starting shaft;

wherein the center axis of the starting shaft aligns with the center axis of the rotor of the starting motor;

wherein the axis of rotation of the starting shaft aligns with the axis of rotation of the starting motor.

10. The portable engine starter for vehicle racing according to claim 9 wherein the power circuit is an electrical circuit;

wherein the power circuit electrically connects to the starting motor;

wherein the power circuit transmits electrical energy from the battery to the starting motor;

wherein the power circuit controls the flow of electrical energy to the starting motor;

wherein the power circuit comprises the battery and the switching circuit.

11. The portable engine starter for vehicle racing according to claim 10 wherein the battery is an electrochemical device;

wherein the battery contains chemical potential energy;

wherein the battery converts the stored chemical potential energy into electrical energy;

wherein the battery further comprises a battery port.

12. The portable engine starter for vehicle racing according to claim 11 wherein the switching circuit is an electrical circuit;

wherein the switching circuit controls the operation of the portable engine starter for vehicle racing by controlling the flow of electrical energy into the starting motor;

wherein the switching circuit comprises a starting circuit;

wherein the starting circuit is an electrical circuit;

wherein the starting circuit electrically connects the battery to the starting motor;

wherein the starting circuit transports the electrical energy generated by the battery to the starting motor;

wherein the starting circuit further comprises a starting switch and a relay.

13. The portable engine starter for vehicle racing according to claim 12 wherein the relay is an electrically operated switch;

wherein the relay controls the flow of electrical energy from the battery to the starting motor;

wherein the relay comprises one or more normally open switches;

wherein the relay further comprises a relay coil and a relay switch structure.

14. The portable engine starter for vehicle racing according to claim 13 wherein the relay coil is an electrical structure;

wherein the relay coil actuates the relay switch structure to a closed position when the relay coil receives electrical energy from the battery;

wherein the relay switch structure forms an electrical connection between the battery and the starting motor that feeds electrical energy to the starting motor.

15. The portable engine starter for vehicle racing according to claim 14 wherein the starting switch is a momentary switch;

wherein the starting switch is a normally open switch;

wherein the starting switch controls the flow of electrical energy from the battery to the relay coil of the relay;

wherein the starting switch maintains the relay coil in an energized condition until the starting switch is deactivated.

16. The portable engine starter for vehicle racing according to claim 15 wherein the portable engine starter for vehicle racing comprises a voltage gauge and a voltage gauge switch;

wherein the voltage gauge measures and displays the voltage level of the battery when the voltage gauge switch is activated;

wherein the voltage gauge switch is a momentary contact switch such that the voltage gauge is electrically disconnected to avoid draining the battery.

17. The portable engine starter for vehicle racing according to claim 15 wherein the portable engine starter for vehicle racing is configured to detachably couple to a dragster.

18. The portable engine starter for vehicle racing according to claim 17 wherein the portable engine starter for vehicle racing couples to the front of the engine at a blower.

19. The portable engine starter for vehicle racing according to claim 15 wherein the portable engine starter for vehicle racing is configured to detachably couple to an Indy car.

20. The portable engine starter for vehicle racing according to claim 19 wherein the portable engine starter for vehicle racing rests on the ground behind the Indy car and couples to the engine via a gear set and a socket.

* * * * *